US008733051B2

(12) United States Patent
Griffith

(10) Patent No.: US 8,733,051 B2
(45) Date of Patent: May 27, 2014

(54) BUILDING BLOCK ASSEMBLY

(71) Applicant: Rampf Molds Industries, Inc., Hagerstown, MD (US)

(72) Inventor: Tom Griffith, Barrie (CA)

(73) Assignee: Rampf Molds Industries, Inc., Hagerstown, MD (US)

( * ) Notice: Subject to any disclaimer, the term of this patent is extended or adjusted under 35 U.S.C. 154(b) by 0 days.

(21) Appl. No.: 13/663,795

(22) Filed: Oct. 30, 2012

(65) Prior Publication Data

US 2014/0115992 A1 May 1, 2014

(51) Int. Cl.
*E04F 15/22* (2006.01)

(52) U.S. Cl.
USPC ..... 52/396.09; 52/405.1; 52/605; 277/316; 405/284

(58) Field of Classification Search
USPC ..... 52/596, 605, 405.1, 407.1, 606, 396.04, 52/406.3, 396.06, 396.08, 396.09, 61; 405/284, 152; 277/312, 316, 644
See application file for complete search history.

(56) References Cited

U.S. PATENT DOCUMENTS

| | | | | | |
|---|---|---|---|---|---|
| 2,869,356 | A | * | 1/1959 | Kulhavy et al. | 52/396.09 |
| 3,099,110 | A | * | 7/1963 | Spaight | 52/396.09 |
| 3,119,204 | A | * | 1/1964 | Williams | 52/396.09 |
| 3,813,838 | A | * | 6/1974 | Brown et al. | 52/396.09 |
| 3,982,369 | A | | 9/1976 | Keleske | |
| 4,269,013 | A | | 5/1981 | West | |
| 4,365,818 | A | * | 12/1982 | Tolliver | 277/626 |
| 4,498,266 | A | | 2/1985 | Perreton | |
| 4,741,542 | A | * | 5/1988 | Kimerly | 277/316 |
| 4,817,963 | A | * | 4/1989 | Munden et al. | 277/316 |
| 4,833,852 | A | | 5/1989 | West | |
| 5,290,045 | A | * | 3/1994 | Terauchi et al. | 277/312 |
| 5,735,633 | A | * | 4/1998 | Metzger | 404/65 |
| 6,129,485 | A | * | 10/2000 | Grabe et al. | 405/152 |
| 6,434,904 | B1 | * | 8/2002 | Gutschmidt et al. | 52/393 |
| 6,592,296 | B2 | * | 7/2003 | Gutschmidt et al. | 405/152 |
| 6,705,057 | B2 | | 3/2004 | Smyer, III | |
| 6,722,094 | B1 | | 4/2004 | Judd et al. | |
| 6,827,527 | B2 | * | 12/2004 | Conkel et al. | 405/284 |
| 6,978,581 | B1 | | 12/2005 | Spakousky | |
| 6,997,640 | B1 | * | 2/2006 | Hohmann, Jr. | 404/67 |
| 7,305,803 | B2 | | 12/2007 | Correa et al. | |
| 7,544,014 | B1 | * | 6/2009 | Bergmann | 405/262 |
| 7,739,845 | B2 | | 6/2010 | Kennedy | |
| 2003/0118410 | A1 | * | 6/2003 | Race | 405/302.7 |
| 2004/0022587 | A1 | * | 2/2004 | Conkel et al. | 405/284 |
| 2007/0028558 | A1 | | 2/2007 | Lopes | |
| 2009/0198311 | A1 | * | 8/2009 | Johnson et al. | 607/109 |
| 2010/0018150 | A1 | | 1/2010 | Azar | |
| 2011/0200390 | A1 | * | 8/2011 | Rodriguez | 405/38 |

FOREIGN PATENT DOCUMENTS

| | | | |
|---|---|---|---|
| WO | 2004/109028 | A1 | 12/2004 |
| WO | 2008/037084 | A1 | 4/2008 |

* cited by examiner

*Primary Examiner* — Brian Glessner
*Assistant Examiner* — Brian D Mattei
(74) *Attorney, Agent, or Firm* — Burr & Brown, PLLC

(57) ABSTRACT

A building block assembly is provided comprising a building block and a seal. In one embodiment, the building block comprises a first surface, and the first surface has a groove. The seal is movable from a first position to a second position. In the first position, the seal is retracted into the groove, and in the second position the seal is extended outside the groove. In another embodiment, the seal is connected to the building block, and the seal at least partially encases a fluid sealant.

16 Claims, 5 Drawing Sheets

BUILDING BLOCK ASSEMBLY

FIELD OF THE INVENTION

The present invention relates to a building block for use in construction, and in particular, to a building block with a seal for sealing a joint between the building block and another structure.

BACKGROUND OF THE INVENTION

Water infiltration through walls or other building structures composed of building blocks can be costly, damaging, and dangerous. Erosion, which can be caused by water and/or other elements, can accelerate water infiltration and cause structural instability. Water that infiltrates into a building through the building blocks and/or the building structure can create an excessively humid internal environment, and the excessive humidity can cause further problems, such as, but not limited to, mold growth. Health risks have been increasingly associated with many molds.

Building blocks of various sizes, shapes, and materials have been used in the construction of various structures. Some of the materials have included stone, brick, concrete, cinder, and tile. Many of these materials form a solid and sturdy, but somewhat porous block, with surfaces that are generally rough, or at least not substantially smooth. Regardless of the particular type or shape of the building block, each building block in a construction application is laid adjacent to another structure (e.g., another building block), usually spaced by a bed of mortar. The mortar can at least partially fill the joint between a building block and the adjacent structure.

A single wythe construction method is a relatively inexpensive method in which blocks are stacked in rows to create a structure (e.g., a wall) with the width of a single block. In a below-ground, single wythe application, where ground exists on one side of the building block structure, and open space exists on the other side of the building block structure, ground water can create a pressure greater on one side of the building block structure, forcing water against, into, and/or through the building block structure. In an above-ground, single wythe application, where one side of the building block structure is exposed to an external environment and the weather, and the other side of the building block structure is exposed to internal environment protected from the weather, wind creates a pressure difference between the two sides of the building block structure that also forces water against, into, and/or through the building block structure, from the side exposed to the wind toward the side protected from the wind.

Water forced against, into, and/or through the building block structure can work its way through the pores in the actual block, but more prevalently, the water flows through cracks, voids, and gaps in the mortar joints. Cracks in the mortar joint can also result from a variety of causes, such as shifts in the building block structure, degradation of the mortar or block materials, or erosion caused by water and/or other elements. Gaps and voids in the mortar joint can result from a variety of causes also, such as, but not limited to, human imperfection or error during installation of the mortar, or erosion caused by water and/or other elements. For example, water inside a crack that freezes and expands can enlarge the crack.

Some methods attempting to prevent water penetration that involve a single wythe construction include spraying the weather-exposed side of the building block structure with a sealant spray, such as a polyurethane spray, installing a flashing to help drain water away from the building block structure, or fashioning drainage grooves within the building blocks and the building block structure. Unfortunately, these methods have been insufficiently effective. Spray sealants are inefficient, as they do not effectively seal where new cracks form after application of the spray sealant. Drains are inefficient because portions of mortar fall into the drains often when a mason installs the building blocks and mortar, thereby clogging the drains. Screens can be installed to catch the mortar in an attempt to reduce the amount of mortar that clogs the drains, but this installation requires extra work, and masons frequently, or usually, overlook these extra laborious procedures.

Another method that attempts to prevent water penetration involves building two single wythe structures separated by an air gap that serves as a drainage gap. Drainage holes can be built to extend through the width of the exterior structure exposed to weather. The drainage holes can be spaced along the bottom of the structure, so that water that penetrates into or through the exterior structure can drain into the drainage gap and then out of the building structure through the drainage holes. This double wythe method requires more materials, labor, and expense.

It would be desirable to provide a building block that can be used to overcome the disadvantages discussed above.

It would be desirable to provide a building block that can be used to create a single wythe building block structure that, compared to current building block structures, relatively inexpensively and effectively reduces or prevents water penetration through mortar joints.

SUMMARY OF THE INVENTION

To achieve these objects, embodiments of a building block assembly are provided. In one embodiment, the building block assembly comprises a building block and a seal. The building block comprises a first surface, and the first surface has a groove. The seal is movable from a first position to a second position. In the first position, the seal is retracted into the groove, and in the second position the seal is extended outside the groove.

In some aspects of this embodiment, the seal is integral with the building block.

In some aspects of this embodiment the building block has a length and the groove extends the length.

In some aspects of this embodiment, in the first position the seal is entirely to a first side of the first mating surface within a perimeter of the building block, and in the second position, the seal extends entirely to a second side of the first mating surface outside the perimeter of the building block.

In some aspects of this embodiment, the seal is rotatable from the first position to the second position.

In some aspects of this embodiment, the seal mates against the first mating surface in the second position.

In some aspects of this embodiment, the seal is fastened to the building block by one from the group consisting of a hinge, an adhesive, an adhesive tape, a spring element, and a clip.

In some aspects of this embodiment, an adhesive is attached between the building block and the seal along the length of the building block.

In some aspects of this embodiment, in the first position, the seal is held by a first retention element, the first retention element configured to be releasable.

In some aspects of this embodiment, the seal is retained in the second position by a second retention element.

In some aspects of this embodiment, the seal is biased toward the second position.

In some aspects of this embodiment, the building block comprises a second mating surface adjacent or opposite the first mating surface, the second mating surface having a flat region extending a length of the building block.

In some aspects of this embodiment, the building block comprises a second mating surface adjacent or opposite the first mating surface, the second mating surface having a groove extending a length of the building block.

In some aspects of this embodiment, the seal comprises an elastomeric material at least partially encapsulating a fluid sealant.

In some aspects of this embodiment, the seal comprises at least one opening to allow the fluid sealant to escape out the seal when a specified pressure is applied to the seal.

In another embodiment, the building block assembly comprises a building block and a longitudinal, elastomeric seal. The seal at least partially encases a fluid sealant.

In some aspects of this embodiment, the seal comprises at least one opening from which the fluid sealant can escape when a predetermined amount of physical force is applied to the seal.

In some aspects of this embodiment, the at least one opening is covered by a thin, breakable membrane.

In some aspects of this embodiment, the at least one opening is closed when pressure on the seal is below a threshold level.

In some aspects of this embodiment, the seal is movably connected to the building block, the seal being movable from a first position to a second position, in the first position the seal being recessed within the building block, and in the second position the seal being extended outside the building block.

These and other features and advantages of the present invention will be better understood from the following detailed description taken in conjunction with the accompanying drawings.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
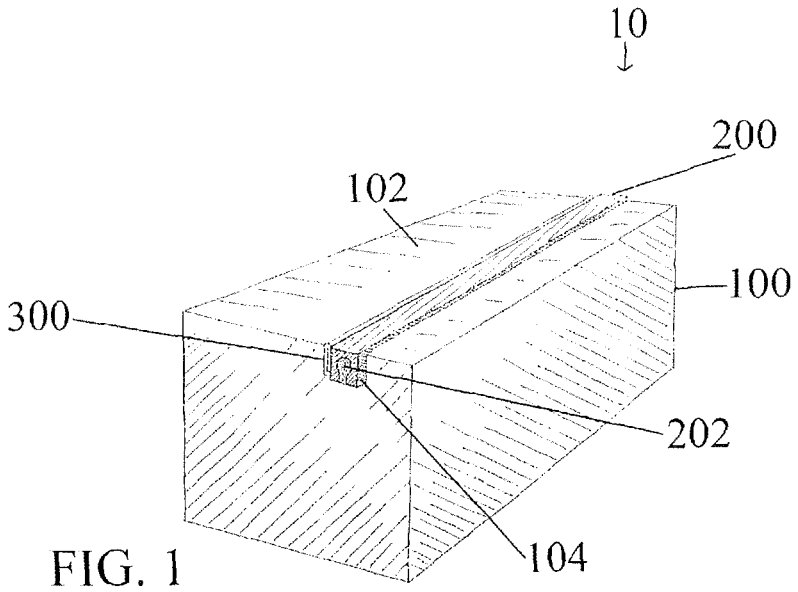
FIG. 1 is an isometric view of a building block assembly with a seal in a first position, in accordance with one embodiment.

FIG. 1 is an isometric view of a building block assembly 10 with a seal 200 in a first position, in accordance with one embodiment. The building block assembly 10 comprises a building block 100 and the seal 200. The illustrated building block 100 is substantially shaped like a three-dimensional rectangle, with six substantially flat sides, though the building block 100 can have numerous other shapes, depending on the application and the desired shape, as long as at least a first mating side has a surface that substantially fits in a desirable fashion with another surface of another structure (e.g., another building block). Some building blocks 100 can be homogeneously composed of a single material, such as, but not limited to concrete, while others can be composed of multiple materials. For example, some building blocks 100 can comprise a thermal insulation element that can be composed by a material with a specified thermal insulation capacity.

The building block 100 illustrated in FIG. 1, has a first mating side 102 with a groove 104 extending along the length of the first mating side 102. The groove 104 is dimensioned to accommodate positioning of the seal 200 partially or wholly within the groove 104. In the embodiment illustrated in FIG. 1, the groove 104 is deep enough so that the seal 200 can fit in the groove 104 and be entirely recessed with respect to the surface of the first mating side 102. The groove 104 is at least as wide as the seal 200, and in some embodiments wide enough so that the seal 200 can rotate out of the groove 104. The seal 200 can rotate out of the groove 104 by pivoting on a pivot point, such as a point where the seal 200 is attached to the building block 100.

Figure 9:
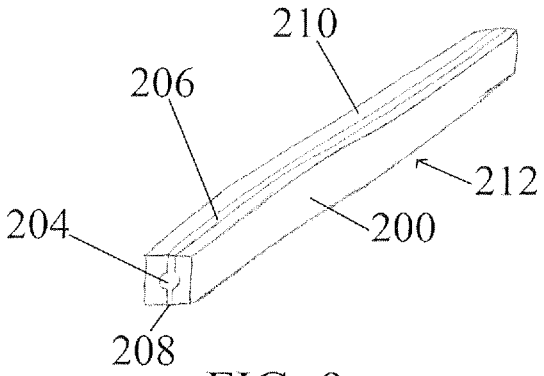
FIG. 9 is an isometric view of a building block assembly seal according to one embodiment.

The seal 200 can be formed of a seal material, such as, but not limited to, an elastomer, a rubber, or a plastic. The seal 200 can be flexible, deformable, or elastically deformable, to flex, deform, or elastically deform, and seal between rough or imperfectly smooth surfaces of building blocks and/or building structures. Referring also to FIG. 9, the seal 200 can have open ends 204, and an open slot 206 that extends lengthwise along a first mating side 210 of the seal 200. In the first position, in this embodiment in which the seal 200 rotates out of the groove 104, the open slot 206 faces into the groove 104. In some embodiments, the seal 200 can also comprise a second open slot 208 that extends lengthwise along the seal 200 on a second mating side 212 of the seal 200, the second mating side 212 of the seal 200 directly opposing the first mating side 210. With each of the open slot 206 and/or the open slot 208, the seal 200 can encase or partly encase a fluid sealant 202, as shown in FIG. 1. The fluid sealant 202 can fluidly communicate outside the seal 200 through the open ends 204, the open slot 206, and/or the open slot 208. In some embodiments, the seal 200 has closed ends, rather than open ends 204, to prevent leakage of the fluid sealant 202 out the ends.

Figure 10:
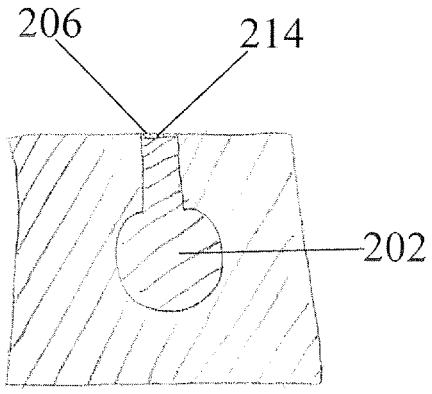
FIG. 10 is a cross section of a building block assembly seal according to one embodiment and FIG. 11 is a cross section of a building block assembly seal according to one embodiment.
Figure 11:
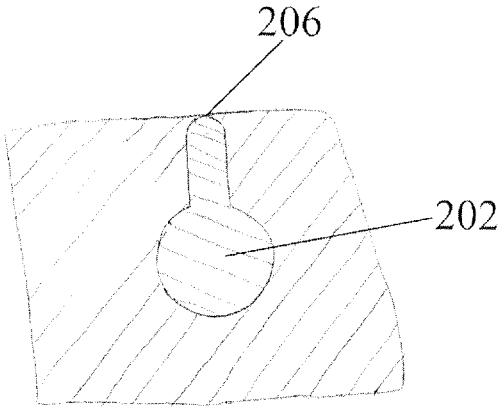

The size of the openings 204, 206, 208 and/or the viscosity of the fluid sealant can reduce or prevent the fluid sealant from leaking prematurely, before installation of the building block assembly 10. For example, a relatively small opening 204, 206, 208 and/or a relatively high viscosity can reduce or prevent the fluid sealant 202 from leaking without a force acting on the seal 200 and/or the fluid sealant 202 to expel the fluid sealant 202 from the seal 200. Alternatively, a thin, breakable membrane 214, as illustrated in FIG. 10, can cover one or more of the openings 204, 206, 208 in order to promote the retention of the fluid sealant 202 within the seal 200 until installation of the building block assembly 10. As illustrated in FIG. 11, the seal 200 can also be configured so that one or more of the openings 204, 206, 208 close around the fluid sealant 202 and remain closed when pressure on the seal 200 is below a threshold level.

The seal 200 can be integral with the building block 100. In one embodiment, the seal 200 can be movably attached to the building block 100 by a fastener. A variety of fasteners can be used. In the embodiment depicted in FIG. 1, the fastener comprises an adhesive tape 300 adhered to an inside surface of the groove 104, and to the seal 200. The adhesive tape 300 can extend less than the entire length of the groove 104 and/or the seal 200, or it can extend the full length of the groove 104 and/or the seal 200. In the latter case, the adhesive tape 300 can act to enhance the sealing function between the building block 100 and the seal 200. Other fasteners might comprise hinges, glues, or other known fasteners.

FIG. 1 illustrates the seal 200 in the first position, in which the seal 200 is retracted, or recessed, into the groove 104. In the recessed first position, the seal 200 can be entirely to a first side of the first mating surface 102 within a perimeter of the building block 100. In the first position, in this embodiment in which the seal 200 rotates out of the groove 104, the open slot 206 faces into the groove 104.

Figure 2:
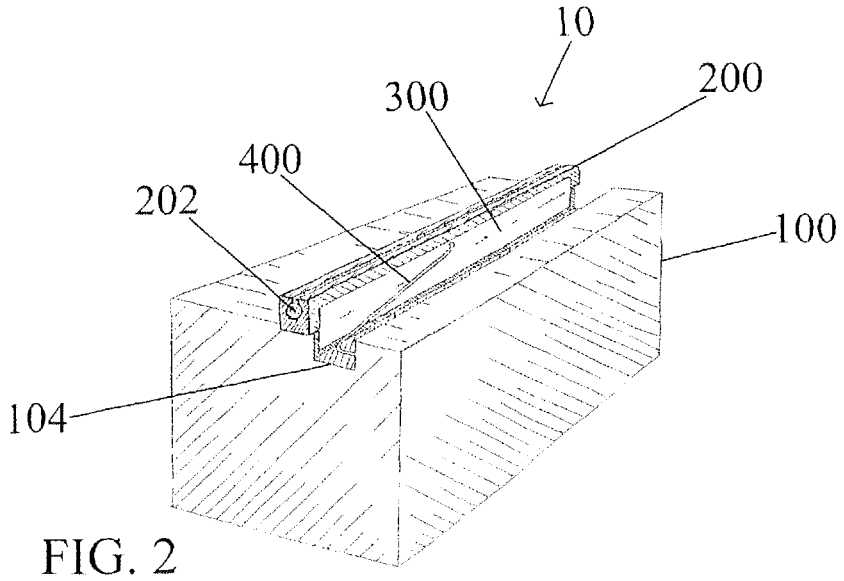
FIG. 2 is an isometric view of the building block assembly of FIG. 1, with the seal in a second position, in accordance with one embodiment.

FIG. 2 is an isometric view of the building block assembly 10 of FIG. 1, with the seal 200 in a second position, in accordance with one embodiment. In the second position, the seal 200 is extended out of the groove 104 onto the surface of the first mating side 102 of the building block 100. In the second position, the seal can extend entirely to a second side of the first mating surface 102 outside the perimeter of the building block 100. In the second position, the open slot 206 faces away from the groove 104 and away from the first mating side 102 of the building block 100. In FIG. 2, the seal 200 is extended out of the groove 104 by rotation of the seal 200. In FIG. 2, the seal 200 has been rotated around an axis that extends along the length of the adhesive tape 300 between where the adhesive tape 300 is adhered to an inside surface of the groove 104 and where the adhesive tape 300 is adhered to a side of the seal 200. In other embodiments, the seal 200 could be moved in varying fashions not involving rotation, to move the seal 200 from the first position to the second position. For example, in one embodiment, the seal 200 could be moved in a straight path out of the groove 104, and then moved in a straight path over the mating surface 102 of the building block 100, before moving into the second position where the seal 200 contacts and seals against the first mating surface 102 of the building block 100.

A variety of mechanisms can be used to retain the seal 200 in the first position of retraction, move the seal 200 into the second position of extension, and/or retain the seal 200 in the second position of extension. The seal 200 can be manually moved from the first position to the second position, or as exemplified in FIG. 2, the seal 200 can be manually prompted or released to move from the first position to the second position.

Figure 3:
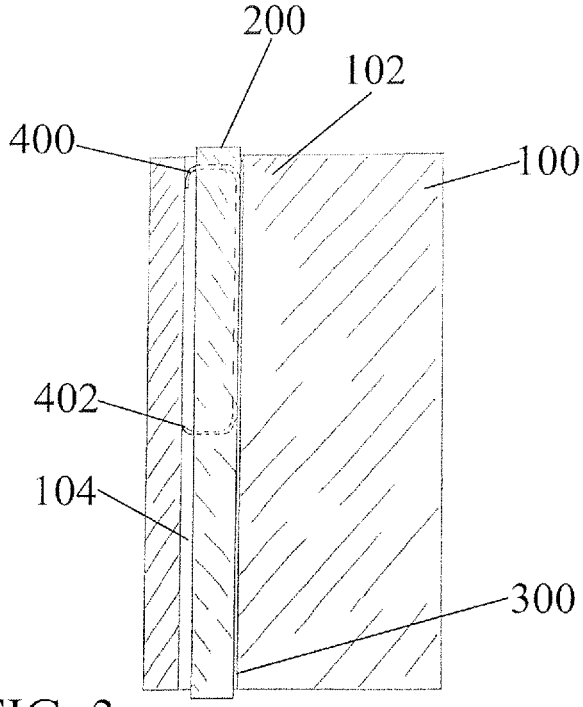
FIG. 3 is a top view of the building block assembly with the seal in the first position, using a torsion spring to move the seal between the first position and the second position, according to one embodiment.

FIG. 3 is a top view of the building block assembly 10 illustrated in FIG. 2, with the seal 200 in the first position, and with a spring 400 biased to move the seal 200 into the second position. As shown in FIG. 2 and FIG. 3, the spring 400 can be secured in the groove 104 by pressure against the inside opposing walls of the groove 104. The spring 400 can be attached to the seal 200 at one end, such as by piercing through the seal. In the first position, the spring 400 can bias the seal 200 toward the second position, and a first retention element can act against the spring 400 to retain the seal 200 in the first position, until a time desirable for the seal 200 to be moved into the second position, at which time the first retention element is released.

Figure 4:
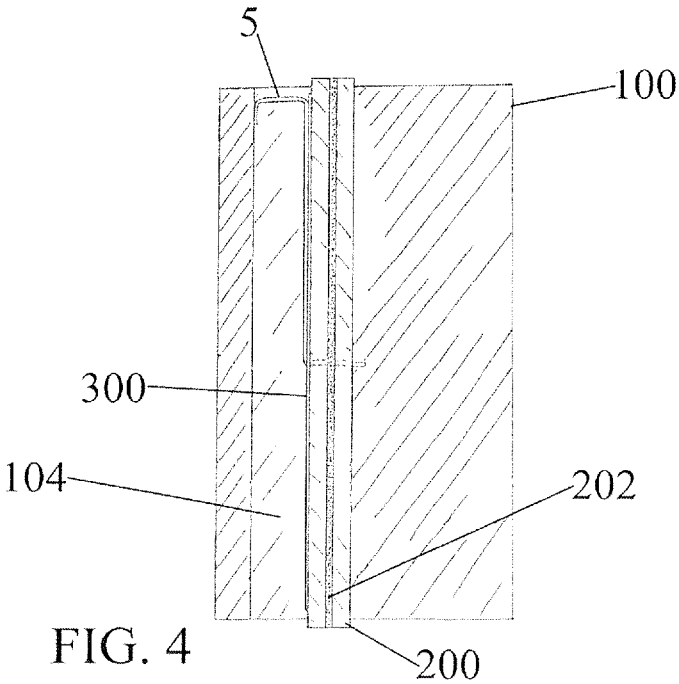
FIG. 4 is a top view of the building block illustrated in FIG. 3, with the seal in the second position.

A variety of first retention elements are possible. Some examples include tape or another form of removable or breakable adhesive, a latch, or a trigger. Numerous other types of first retention elements could be used as well. In the embodiment illustrated in FIG. 3, a retainer end 402 of the spring 400 attached to the seal 200 can have a section extending across the width of the groove 104 that is releasably pressed between the two opposing inside walls of the groove 104. A trowel or another tool can be used to easily pry this retainer end 402 of the spring 400 out of the groove 104 to release the seal 200 and allow the seal 200 to rotate into the second position. The first retention element can be limited in its positioning away from the first mating side 210 and/or the second mating side 212 of the seal 200 to reduce or prevent the chance that the first retention element interferes with the sealing function of the seal 200. FIG. 4 illustrates a top view of the building block depicted in FIG. 3, with the seal 200 released into the second position.

Whichever first retention element is used, a building structure builder can unload a stack of building blocks 100, with the seals 200 in the first, retracted position, where the seals 200 are relatively safe from being scraped, banged, or otherwise damaged as the building blocks 100 are potentially slid, scraped, and banged against each other. Retracted into the groove 104, each seal 200 is protected from damage. Generally, the further the seals 200 are recessed with respect to the mating surface 102 of the building block 100, the more protected the seals 200 are. In embodiments where the seal 200 is recessed entirely below the surface, the seal 200 is protected from grating against a heavy second building block 100 sliding across the mating surface 102 that might otherwise strike and/or grate across the seal 200, such as during transportation, loading, and/or unloading of a stack of building blocks 100. The building structure builder, before or during installation of the building blocks 100, can relatively effortlessly rotate each seal 200 from the first position to the second position, for example, by flipping out each seal 200 using fingers or a trowel, or by releasing the first retention element.

In the second position, a second retention element can retain the seal 200 as well. In the illustrative embodiment, the spring 400, through its spring force biasing the seal 200 toward the second position, also acts as a second retention element to retain the seal 200 in the second position. Other second retention elements 200 are conceived, such as but not limited to, latches, hooks, buttons, snaps, and adhesive. The spring 400 works well as a retention element, in part, because the spring 400 is recessed within the groove 104 and does not interfere with the mating of the first mating surface 102 of the building block 100 with either the seal 200 or another building structure.

Figure 5:
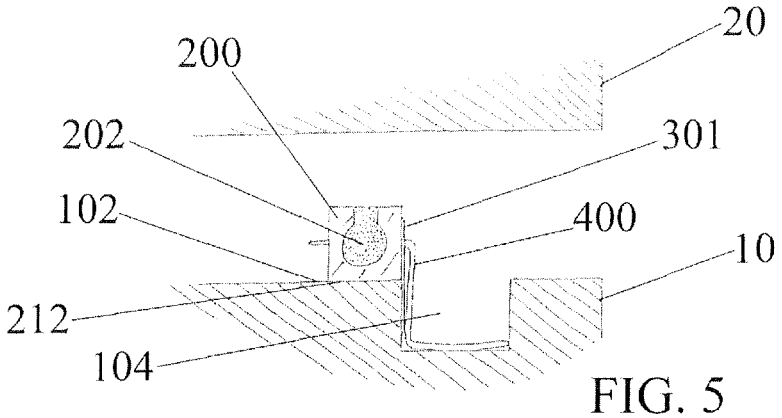
FIG. 5 is a side view of the building block assembly, illustrating the seal in the second position and the building block assembly ready to be installed with another building structure.

FIG. 5 is a side view of the building block assembly 10, illustrating the seal 200 in the second position and the building block assembly 10 ready to be installed with another building structure, which in this illustrated embodiment, is a second building block assembly 20. In the extended, second position, the second mating surface 212 of the seal 200 mates with the surface of the first mating side 102 of the building block 100. The fluid sealant 202 in the first open channel 206 opens to the first mating surface 210 of the seal 200 and faces away from the mating surface 102 of the building block 100 in the second position, and faces toward the second building block assembly 20, against which the building block assembly 10 is prepared to be installed.

Figure 6:
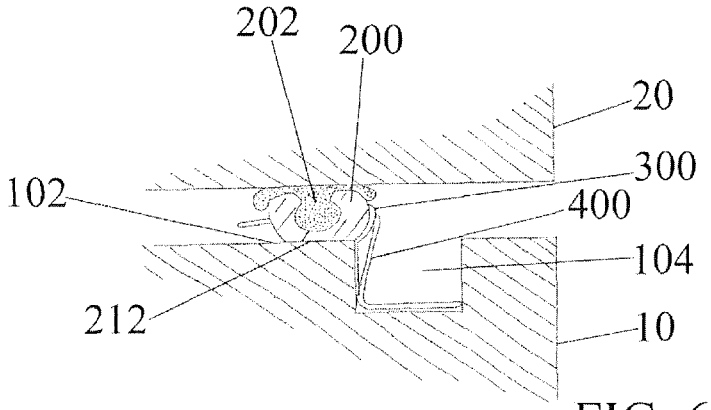
FIG. 6 is a side view of the building block assembly, illustrating the seal in the second position and the building block assembly installed with a another building structure.

FIG. 6 is a side view of the building block assembly 10, illustrating the seal 200 in the second position and the building block assembly 10 installed with the second building block assembly 20. The seal 200 is dimensioned so that in the second position, the seal 200 extends from the first mating side 102 of the building block assembly 10 far enough to abut and seal against the second building block assembly 20, when the second building block assembly 20 is properly spaced from the building block assembly 10 with a proper amount of mortar therebetween, as determined by standards of the relevant trade. For example, in some embodiments, a 10 mm thick mortar bed (post installation of the building block assembly 10 with the second building block assembly 20) might be standard, in which case the seal 200 would be dimensioned to extend from the first mating side 102 of the building block assembly 10 at least 10 mm, plus any desirable compression distance, between the building block assembly 10 and the second building block assembly 20, in a non-deformed state, in the second position, before being compressed between the two block assemblies 10, 20. The precise distance greater than 10 mm would depend upon the nature of the seal material and how much compression of the seal 200 would be necessary or desirable to obtain a water-tight seal.

As discussed above, the surfaces of the building block 100 can be rough, or not substantially smooth. When the building block assembly 10 is assembled with the second building block assembly 20, with the appropriate amount of mortar (not shown) laid between the first mating side 102 of the building block 100 and the second building block assembly 20, the seal 200 is flexed, deformed, or elastically deformed to mate with both the building block 100 and the second building block assembly 20, forming a seal that seals against water penetration in the joint between the building block assembly 10 and the second building block assembly 20. In the embodiment depicted in FIG. 6, the adhesive tape 300 adds further sealing power between the seal 200 and the building block 100.

Figure 7:
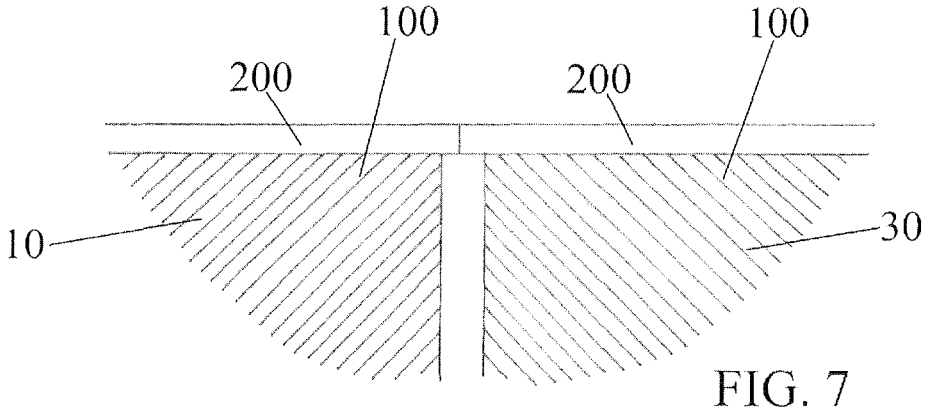
FIG. 7 is a front view of the building block assembly, illustrating the seal in the second position and the building block assembly installed adjacent lengthwise with another building block assembly.

FIG. 7 is a front view of the building block assembly 10, illustrating the seal 200 in the second position and the building block assembly 10 installed adjacent lengthwise with a third building block assembly 30. The seal 200 can extend lengthwise beyond the length of the building block 100 and/or the groove 104, and overhang the end of the building block 100. The seal 200 of the building block 10 can be aligned and/or coextensive with the seal 200 of the third building block 30 so that the seal 200 of the building block 10 and the seal 200 of the third building block 30 seal against each other. In the compressed state, the seals 200 can each extend one half the width of the mortar joint between the building block assembly 10 and the third building block assembly 30. Before being compressed, the seals 200 can extend one-half the width of the mortar joint plus a distance to allow for a desirable amount of compression.

Referring to the embodiments depicted in FIG. 6 and FIG. 7, when the building block 100 is mated to the second building block assembly 20, and the fluid sealant 202 is used, the pressure applied to the seal 200 can force the fluid sealant 202 out the openings 204, 206 (and/or the opening 208 in embodiments comprising opening 208). If the thin membrane 212 covers the fluid sealant 202, the thin membrane 212 breaks under the pressure applied during the installation of the building block assembly 10 against the second building block assembly 20. Likewise, if the openings 204, 206 (and/or the opening 208 in embodiments comprising the opening 208) are configured to close around the sealant 202, then the pressure applied to the seal 200 during installation of the building block assembly 10 exceeds a threshold level sufficient to force the openings 204, 206 (and the opening 208 in embodiments comprising the opening 208) to open and expel the fluid sealant 202.

The fluid sealant 202 can add extra sealing capability between the building structure assembly 10 and the second building block assembly 20. In embodiments when the surfaces of the building block 100 and/or the other structure are rough or not smooth, the fluid sealant 200 can easily flow into the pits or rough areas. Fluid sealant 202 that escapes from open ends 204 can add sealing capability between the building block assembly 10 and any other building structure adjacent to the open ends 204, such as the seal 200 of the third building block assembly 30. The open ends can also allow some fluid sealant 202 to escape to allow proper flexing or deformation of the seal 200.

After escaping the open channel 206 and/or the open ends 204 (and/or the open channel 208 in embodiments comprising the open channel 208), the fluid sealant 202 can remain fluid, or the fluid sealant 202 can harden. If the fluid sealant 202 remains fluid, then the fluid sealant 202 can flow to till any voids or gaps created after installation of the building block assembly 10, such as voids or gaps created by shifting of the building structure. A fluid sealant 202 that remains fluid can also endure indefinitely between manufacture of the building block assembly 10 and installation of the building block 10, without steps taken to prevent the fluid sealant 202 from drying/hardening undesirably before installation.

Figure 8:
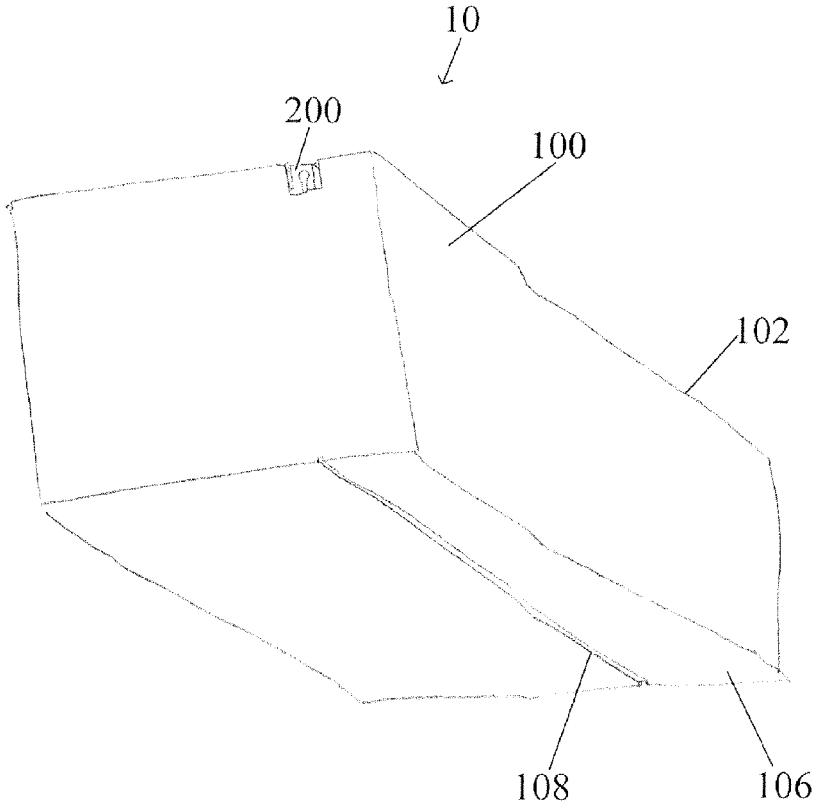
FIG. 8 illustrates a second mating side of a building block, according to one embodiment.

FIG. 8 illustrates a second mating side 106 of a building block 100. The building block 100 illustrated in FIG. 8 can comprise a second mating side 106 that opposes or is adjacent to the first mating side 102 (not shown in FIG. 8). The second mating side 106 can be configured to mate with the first mating side 102 (not shown in FIG. 8) of another building block. The second mating side 106 can have a flat surface positioned to mate against the seal 200. The second mating side 106 can also have a slight groove 108 that can act as a drip edge, as shown in FIG. 8.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A building block assembly comprising:

a building block having at least a first mating surface, the first mating surface having at least one groove; and a seal, the seal being movable from a first position to a second position, the seal being retracted into the groove in the first position, and the seal being extended outside the groove in the second position, the seal being integral with the building block in the first position and in the second position.

2. A building block assembly as recited in claim 1, wherein the building block has a length and the groove extends the length of the building block.

3. The building block as recited in claim 2, wherein an adhesive is attached between the building block and the seal along the length of the building block.

4. The building block assembly as recited in claim 1, wherein in the first position the seal is entirely to a first side of the first mating surface within a perimeter of the building block, and in the second position, the seal extends entirely to a second side of the first mating surface outside the perimeter of the building block.

5. The building block assembly as recited in claim 1, wherein the seal is rotatable from the first position to the second position.

6. The building block assembly as recited in claim 1, wherein the seal mates against the first mating surface in the second position.

7. The building block assembly as recited in claim 1, wherein the seal is fastened to the building block by one from the group consisting of a hinge, an adhesive, an adhesive tape, a spring element, and a clip.

8. The building block as recited in claim 1, wherein in the first position, the seal is held by a first retention element, and the first retention element is configured to be releasable.

9. The building block as recited in claim 1, wherein the seal is retained in the second position by a second retention element.

10. The building block as recited in claim 1, wherein the seal is biased toward the second position.

11. The building block assembly as recited in claim 1, wherein the building block comprises a second mating surface adjacent or opposite the first mating surface, the second mating surface having a flat region extending a length of the building block.

12. The building block assembly as recited in claim 1, wherein the building block comprises a second mating surface adjacent or opposite the first mating surface, the second mating surface having a groove extending a length of the building block.

13. The building block assembly as recited in claim 1, wherein the seal further comprises an elastomeric material at least partially encapsulating a fluid sealant.

14. The building block as recited in claim 13, wherein the seal further comprises at least one opening to allow the fluid sealant to escape out the seal when a specified pressure is applied to the seal.

15. The building block assembly as recited in claim 1, wherein the building block is a masonry block.

16. The building block assembly as recited in claim 1, wherein the seal is retracted fully into the groove in the first position.

* * * * *